United States Patent [19]

Hehn

[11] 4,085,532

[45] Apr. 25, 1978

[54] EMBROIDERY HOOPS

[76] Inventor: Bruce Hehn, 110 Shepherd Ter., St. Clairsville, Ohio 43950

[21] Appl. No.: 793,245

[22] Filed: May 3, 1977

[51] Int. Cl.[2] ..... D05C 1/04

[52] U.S. Cl. ..... 38/102.2

[58] Field of Search ..... 38/102.2

[56] References Cited

U.S. PATENT DOCUMENTS

| | | | |
|---|---|---|---|
| 892,961 | 7/1908 | Kohler | 38/102.2 |
| 1,079,042 | 11/1913 | Duncan | 38/102.2 |
| 1,121,920 | 12/1914 | Haidet | 38/102.2 |
| 1,140,506 | 5/1915 | Donahue | 38/102.2 |
| 1,229,857 | 6/1917 | Alyea | 38/102.2 |

*Primary Examiner*—Alfred R. Guest

*Attorney, Agent, or Firm*—Buell, Blenko & Ziesenheim

[57] ABSTRACT

An embroidery hoop having a rigid inner ring and an axially flexible outer ring tension a central portion of fabric from its peripheral portion. The outer ring has a radial discontinuity forming two ends. Structure forming pockets with holes at each end combine with a coil spring to urge the ends toward each other.

1 Claim, 6 Drawing Figures

EMBROIDERY HOOPS

The invention relates to embroidery hoops having flexible outer rings.

Various hoop means are used to tension a portion of embroidery fabric. A fabric is laid over an inner ring having an outer circumferential surface. A radially expandable outer ring having a circumferential inner surface is tightly clamped over the inner ring and fabric to urge the peripheral portion of the fabric intermediate the facing surfaces of the rings away from the central portion of the fabric. These radially expandable type outer rings are difficult to use because considerable dexterity is required in tensioning the fabric.

I have invented a new axially yieldable outer ring which can be axially flexed to partially slip over the inner ring with little effort or dexterity and then can be pushed over the inner ring to create a highly tensioned central portion of fabric. Accordingly, I provide a cylindrical outer ring having two ends formed by a radial discontinuity in the ring; and outer circumferential surface; a radially extending circumferential rib around the outer circumference of the ring; axially extending circumferential segment on the outer edge of the radial rib adjacent each end thereof; a first raised abutment extending outwardly from the outer circumferential surface of the ring to each circumferential segment and spaced from the radial discontinuity in the ring, thereby forming a pocket at each end of the ring; an opening in each pocket of each end in the radially extending rib adjacent to each first raised abutment; and a second raised abutment intermediate each opening and adjacent end. I further provide in combination with the axially yieldable outer ring a coil spring having ends which project tangentially from the coil on the same side of the axis of the coil, each end being turned back on itself to form a hook whereby the spring may be placed in the pockets formed by the outer circumferential surface, the circumferential segments, and the first raised abutments with the ends of the springs extending through the openings and engaging the second raised abutments. Thus with my invention it is not necessary to pull an outer ring apart or to clamp an outer ring down upon the fabric and then tension the fabric. Rather the outer ring is fitted over the fabric to create a tension in the fabric.

Other details, objects and advantages of the invention will become apparent as the following description of a present preferred embodiment thereof proceeds.

In the accompanying drawings, I have shown a present preferred embodiment of the invention in which.

Figure 1:
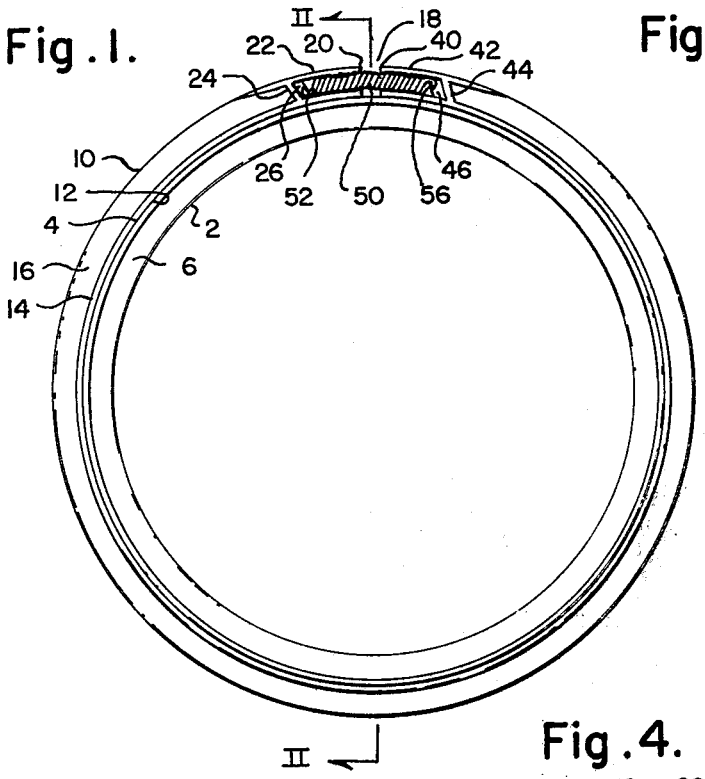
FIG. 1 is a front view of an embroidery hoop including an outer ring embodying my invention and an inner ring.

Referring to the drawings, the circular outer ring 10 has a circumferential inner surface 12 which faces the matching outer circumferential surface 4 of inner ring 2.

The outer circumferential surface 4 of the inner ring 2 is made rigid by reinforcing rib 6 which is an integral part of the inner ring 2. Similarly, outer ring 10 has a circumferential rib 16 radially extending from the outer circumferential surface 14 to create some rigidity in the outer ring.

Outer ring 10 has a radial discontinuity 18 which creates two ends 20 and 40 which permits the outer ring 10 to axially flex or to slightly expand without breaking. Ends 20 and 40 have axially extending circumferential segments 22 and 42 respectively on the outer edge of the radially extending circumferential rib 16, and a first raised abutment 24 and 44 respectively extending outwardly from the outer circumferential surface 14 toward segments 22 and 24 respectively and spaced from radial discontinuity 18 thereby forming a pocket at each end 20 and 40 of the ring. Holes 26 and 46 in each pocket of rib 16 are adjacent the first raised abutments and second raised abutments 28 and 48 in each pocket on surfaces 29 and 49 respectively of rib 16 are intermediate holes 26 and 46 respectively and the radial discontinuity 18.

Ends 20 and 40 are urged toward each other by coil spring 50 having ends 52 and 56 which project tangentially from the coil spring 50 on the same side of the axis of the coil and through holes 26 and 46 respectively when coil spring 50 is placed in the outer ring pockets. Hooked portions 54 and 58, formed by bending end portions 52 and 56 back upon themselves, fix the coil spring 50 to outer ring 10 by engaging second raised abutments 28 and 48 respectively to maintain tension on coil spring 50. As illustrated in the drawings, I prefer to extend the holes 26 and 46 and the second raised abutments 28 and 48 on parallel chords (rather than radially) of the outer circles 10. This permits the hooked portions 54 and 58 of ends 52 and 56 to be turned back on themselves without being turned over the body of the spring. Thus outer ring 10 may be axially flexed and coil spring 50 bent back upon itself without dislodging the coil spring 50 from the pockets of outer ring 10.

Both inner ring 2 and outer ring 10 are formed in injection molds from any suitable plastic composition by conventional methods. Thus each ring is formed in one piece. The spring coil 50 is formed on conventional equipment from any suitable steel.

Figure 2:
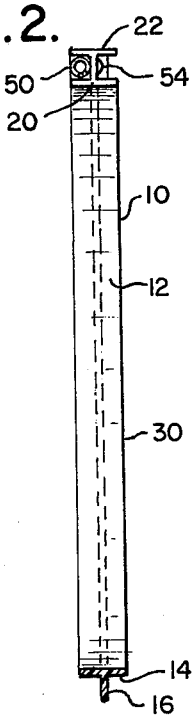
FIG. 2 is a sectional view of the outer ring illustrated in FIG. 1 taken along section line II—II.
Figure 3:
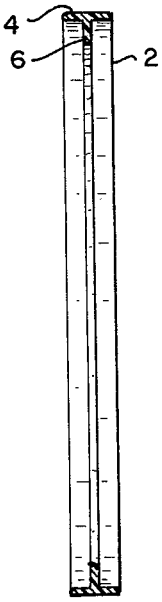
FIG. 3 is a sectional view of the inner ring illustrated in FIG. 1 taken along section line II—II.
Figure 4:
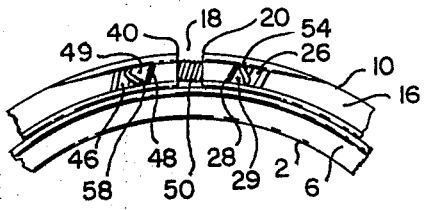
FIG. 4 is a partial back view of the embroidery hoop illustrated in FIG. 1.
Figure 5:
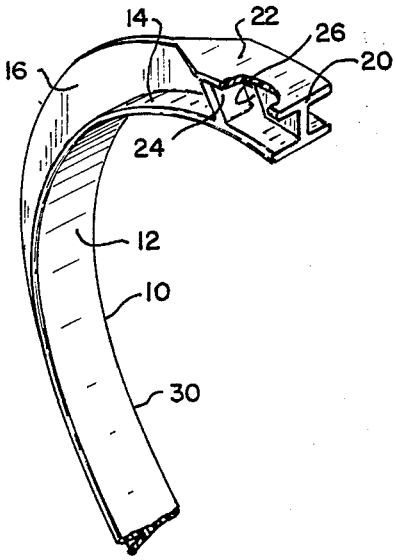
FIG. 5 is a perspective front view of the end of the outer ring illustrated along section line II—II.
Figure 6:
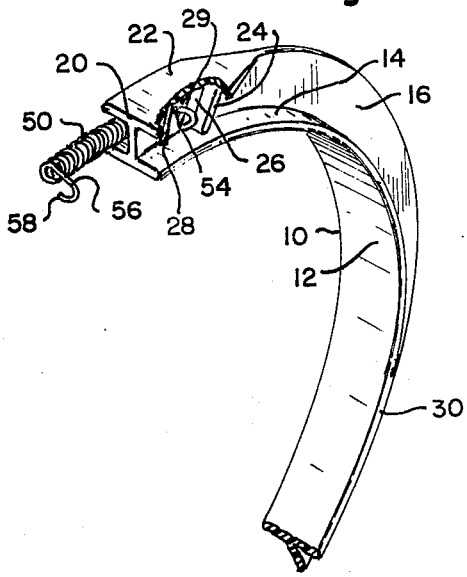
FIG. 6 is a perspective back view of the end of the outer ring illustrated along section line II—II.

In the most advantageous practice of my invention, the outer ring 10 tightly fits over the inner ring 2 without intermediate fabric material between the circumferential surfaces. Fabric material laid over the rigid inner ring 2 of FIG. 3 would have peripheral portions draped over the outer circumferential surface 4. The outer ring 10 as depicted in FIGS. 1 and 2 is held at about 90 degrees to the coil spring 50 and axially flexed to bend coil spring 50 back upon itself to slightly expand the diameter of the inner circumferential surface 12 at edge 30 at about 90 degrees to the spring. The slightly expanded diameter at edge 30 of outer ring 10 is pushed over the draped peripheral portion of fabric and the outer ring is then permitted to flex back to its original shape. The entire outer ring 10 is pushed over the fabric until the inner circumferential surface 12 of the outer ring 10 is facing the outer circumferential surface 4 of the inner ring 2, thereby urging the intermediate peripheral portion of fabric away from the central portion of fabric and creating a tensioning force on the fabric.

While I have shown and described a present preferred embodiment of the invention it is to be distinctly understood that the invention is not limited thereto but may be otherwise variously embodied within the scope of the following claim.

I claim:

1. In hoop means for tensioning a portion of embroidery fabric and the like including an outer ring formed by a yieldable material having a circumferential inner surface adapted to clamp the fabric over and against a cooperating circumferential outer surface of an inner ring, the improvement which comprises a cylindrical outer ring having:

(i) two ends formed by a radial discontinuity in the ring;

(ii) an outer circumferential surface;

(iii) a radially extending circumferential rib around the outer circumference surface of the ring;

(iv) an axially extending circumferential segment on the outer edge of the radial rib adjacent each end thereof;

(v) a first raised abutment extending outwardly from the outer circumferential surface of the ring to each circumferential segment and spaced from the radial discontinuity, thereby forming a pocket at each end of the ring;

(vi) the radially extending rib having an opening in each pocket adjacent to each first raised abutment; and (vii) a second raised abutment intermediate each opening and radial discontinuity, said ring being in combination with a coil spring having ends which project tangentially from the coil on the same side of the axis of the coil, each end being turned back on itself to form a hook whereby the spring may be placed in the pockets formed by ring, the circumferential segments, and the first raised abutment with the ends of the springs extending through the openings and engaging the second raised abutments.

* * * * *